US005685355A

United States Patent [19]

Cook et al.

[11] Patent Number: 5,685,355

[45] Date of Patent: Nov. 11, 1997

[54] CLOSURE SYSTEM

[76] Inventors: Gregory H. Cook, 6775 West El Camino del Cerro, Tucson, Ariz. 85745; Charles E. Cook, 2416 Sierra La., Plano, Tex. 75075

[21] Appl. No.: 555,267

[22] Filed: Nov. 8, 1995

[51] Int. Cl.[6] ..... E05D 15/16

[52] U.S. Cl. ..... 160/202; 160/201; 160/222; 160/32

[58] Field of Search ..... 160/201, 202, 160/32, 37, 33, 35, 222, 223

[56] References Cited

U.S. PATENT DOCUMENTS

| | | | |
|---|---|---|---|
| 1,463,346 | 4/1923 | Walker . | |
| 1,676,500 | 7/1928 | McGinnis . | |
| 1,801,220 | 4/1931 | Brown . | |
| 2,020,544 | 11/1935 | Gill et al. . | |
| 2,423,987 | 7/1947 | Levikow . | |
| 2,668,385 | 9/1954 | Garubo . | |
| 2,897,886 | 8/1959 | Pistelli . | |
| 3,000,437 | 9/1961 | Bennett | 160/33 |
| 3,237,681 | 3/1966 | Huse | 160/193 |
| 3,280,888 | 10/1966 | Davis . | |
| 3,491,400 | 1/1970 | Hubbard . | |
| 3,738,413 | 6/1973 | Frobosilo et al. . | |
| 3,926,242 | 12/1975 | Lowe . | |
| 4,379,478 | 4/1983 | Lichy . | |
| 4,538,661 | 9/1985 | Henry et al. . | |
| 4,662,420 | 5/1987 | Hirao . | |
| 5,022,454 | 6/1991 | Kobayashi et al. | 160/202 |
| 5,133,398 | 7/1992 | Yang et al. | 160/202 X |

FOREIGN PATENT DOCUMENTS

| | | | |
|---|---|---|---|
| 33840 | 11/1964 | Germany | 160/193 |
| 28 01 786 | 7/1979 | Germany . | |
| 477231 | 10/1975 | U.S.S.R. . | |
| 575728 | 4/1945 | United Kingdom . | |
| 709435 | 5/1954 | United Kingdom . | |

*Primary Examiner*—Blair Johnson
*Attorney, Agent, or Firm*—Daniel V. Thompson

[57] ABSTRACT

A closure system includes a plurality of closure panels adapted to be moved between deployed and stowed positions. All on a pair of carrier tracks on opposite side of a building opening. The actuator in the deployed position have abutting top and bottom edges and parallel side surface that span across the building opening. The actuators in the stowed position have abutting in inner and outer side surfaces in parallel top edges and parallel bottom edges. The top and bottom edges maintain their top and bottom orientation as their closure panels transition between the deployed an stowed positions.

7 Claims, 9 Drawing Sheets

CLOSURE SYSTEM

FIELD OF THE INVENTION

This invention relates to doors, windows, and the like, of a kind comprising a number of elongated closure panels moveably interconnected, and more particularly to a stowable closure system wherein the plurality of closure panels is stackable in a stowed position.

BACKGROUND OF THE INVENTION

Closure systems having a plurality of closure panels are almost universally used as closures in such locations as home garages, as well as in commercial garages, warehouses, and other installations where a closure is desired which stores out of the way. The conventional closure system has a carrier track on either side of the opening, and head room must be provided in the interior of the opening to accommodate the door in the raised position. Where a conventional overhead door and carrier track cannot be used, folding or roll-up doors have been utilized. The prior art folding and roll-up doors suffer from a number of disadvantages, however, primarily being the complexity of the mechanism necessary to permit operation. Thus, a need presently exists for a closure system that is economical and simple to produce, as well as effective in accomplishing the overall function of the door which is to completely close the opening in a deployed position and completely open the opening in a stowed position.

SUMMARY OF THE INVENTION

The present invention provides a plurality of closure panels adapted to be moved between deployed and stowed positions along a pair of carrier tracks on either side of a building opening. The closure panels in the deployed position have abutting top and bottom edges and parallel side surfaces to span across the building opening. The closure panels in the stowed position have abutting inner and outer side surfaces and parallel top edges and parallel bottom edges. In the stowed position, the top and bottom edges maintain their top and bottom orientation.

BRIEF DESCRIPTION OF THE DRAWINGS

The invention in its advantages may be understood in more detail by reference to the accompanying drawings, in which.

DETAILED DESCRIPTION OF THE PREFERRED EMBODIMENT

Figure 1:
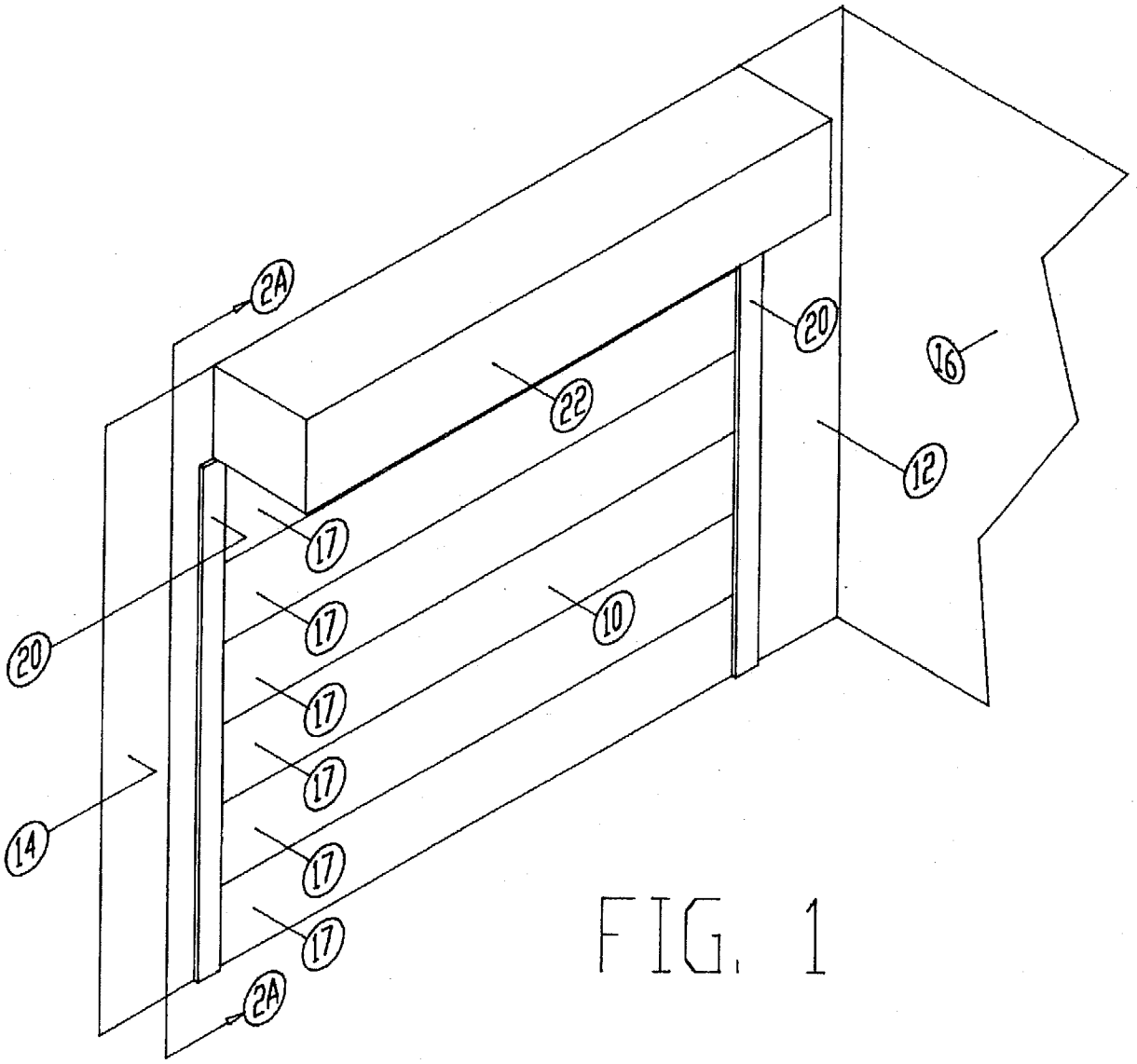
FIG. 1 is a perspective view of a closure system constructed in accordance with the present invention as installed in a building opening.

Referring initially to FIG. 1, a closure system 10 is installed in a building opening having sides 12 and 14. A perpendicular side wall 16 extends from side 12. Closure system 10 includes a plurality of closure panels 17 adapted to be moved between deployed and stowed positions along a pair of carrier tracks 20 on opposite sides 12, 14 of the building opening. FIG. 1 illustrates the closure system in the deployed position. In the deployed position, closure panels 17 span across the opening. At the top of the building opening, is provided an enclosure 22 in which the closure panels 17 are stowed when in the stowed position. As can be seen, closure 22 is relatively compact compared to the overhead space normally required for a conventional overhead door.

FIG. 1 illustrates closure system 10 in an environment where it is vertically oriented in the vertical opening. It will be understood that the closure system is not limited to this environment, and that the system can be oriented horizontally, that is where the closure panels move from side-to-side with carrier tracks being located at the top and bottom of the building opening. It will be understood from this description, and the claims that follow, that terms such as "top", "bottom", and "side" refer only to the preferred embodiment, and that similar structure for a system in a horizontal configuration is the equivalent. In addition, closure panels 17 may be solid for weather, sound and security proofing, such as for a garage door, or equivalently may be open grids for visibility and security, such as for a gate or store front.

Reference is now made to FIGS. 2A–3E, where like numerals indicate like and corresponding elements with FIG. 1. Closure system 10 is shown in the FIGS. 2A and 3A in the deployed position. Each closure panel 17 has an actuator 18 on each end. In the deployed position, actuators 18 have abutting top and bottom edges 30 and 32, which may be seen more clearly in the enlarged views 3A–3E. For clarity purposes, reference numerals 30 and 32 appear only once on FIG. 2A. Reference numerals 30 and 32 are applied in all appropriate instances in FIG. 2B.

The actuators 18 in the closure panel deployed position also have parallel side surfaces 34, such that closure panels 17 span across the building opening. For similar reasons as above, reference numeral 34 only appears once in FIG. 2B, but in all appropriate circumstances in FIG. 2A.

Figure 3A:
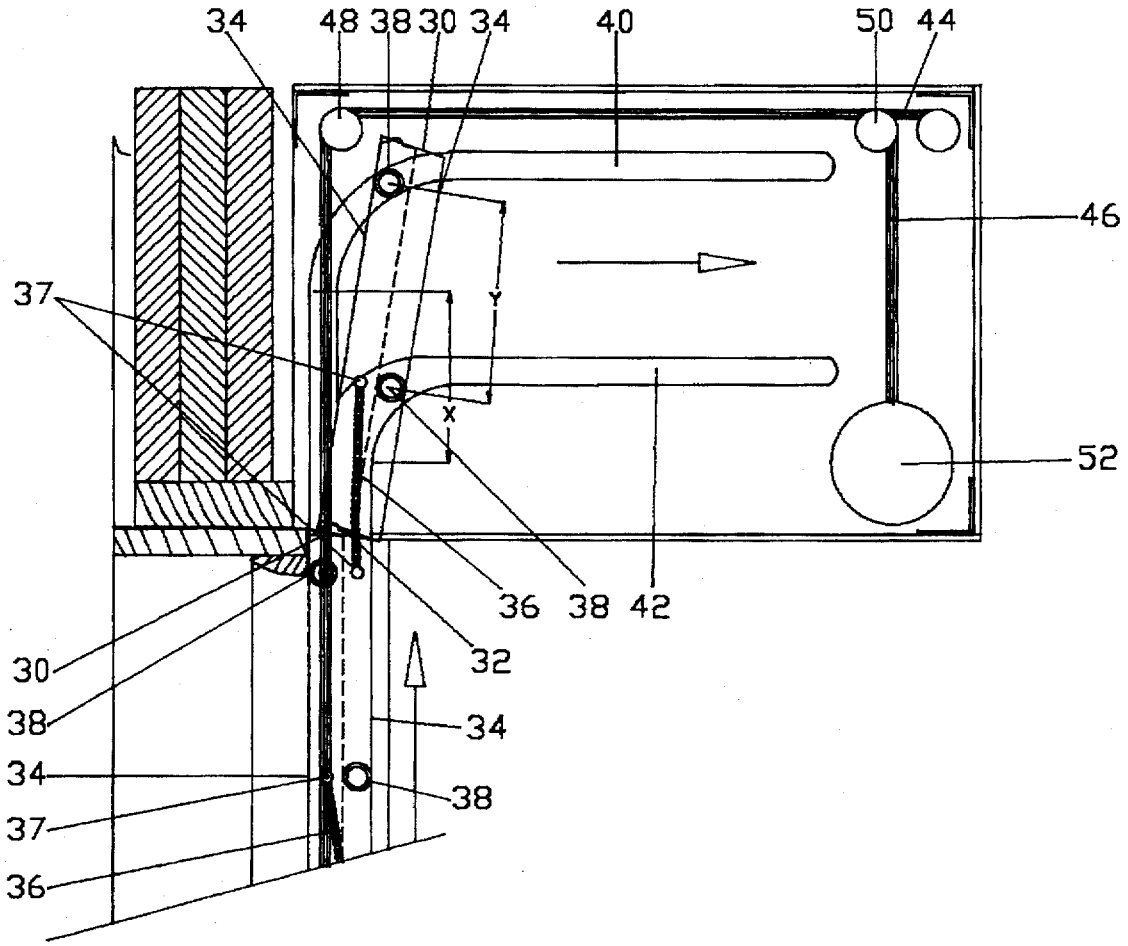
FIGS. 3A–3E are enlarged views showing the sequence of the operation of the invention.
Figure 3B:
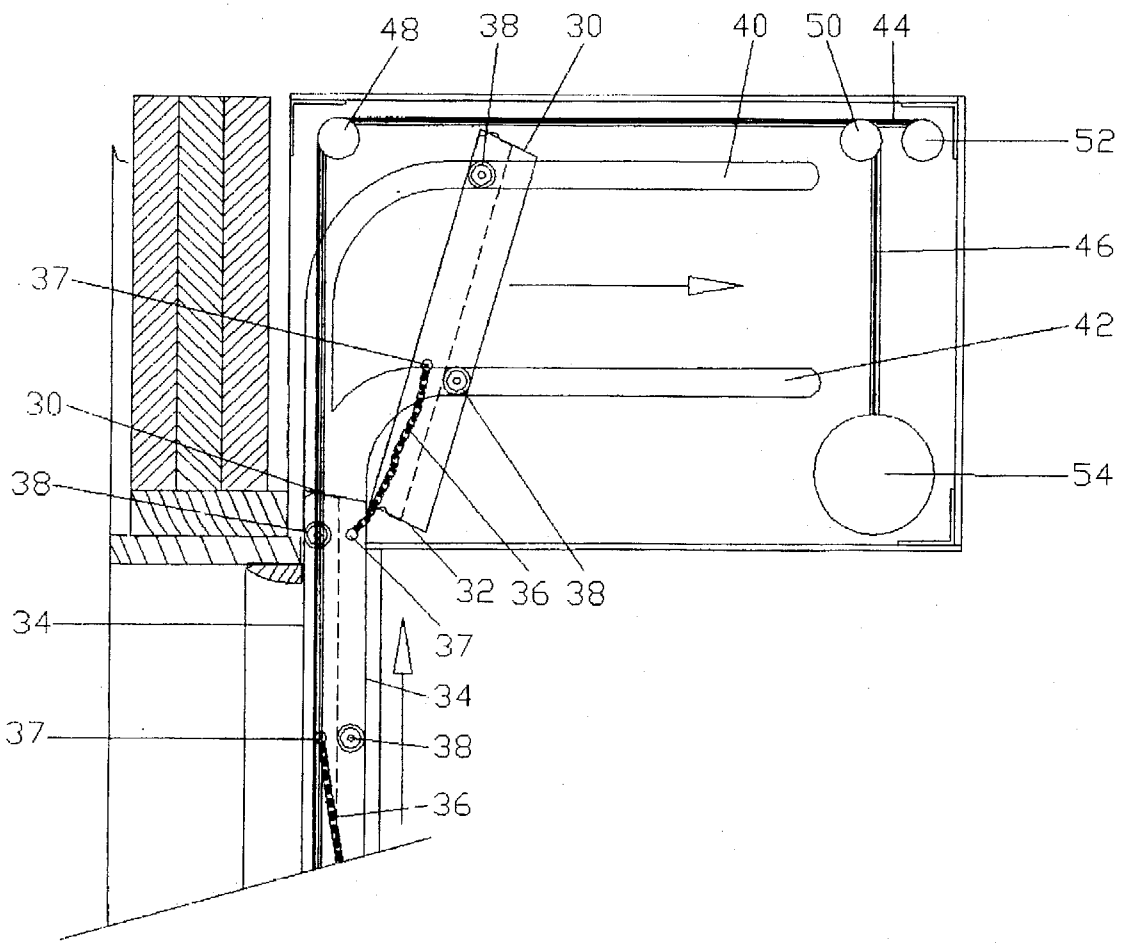
Figure 3C:
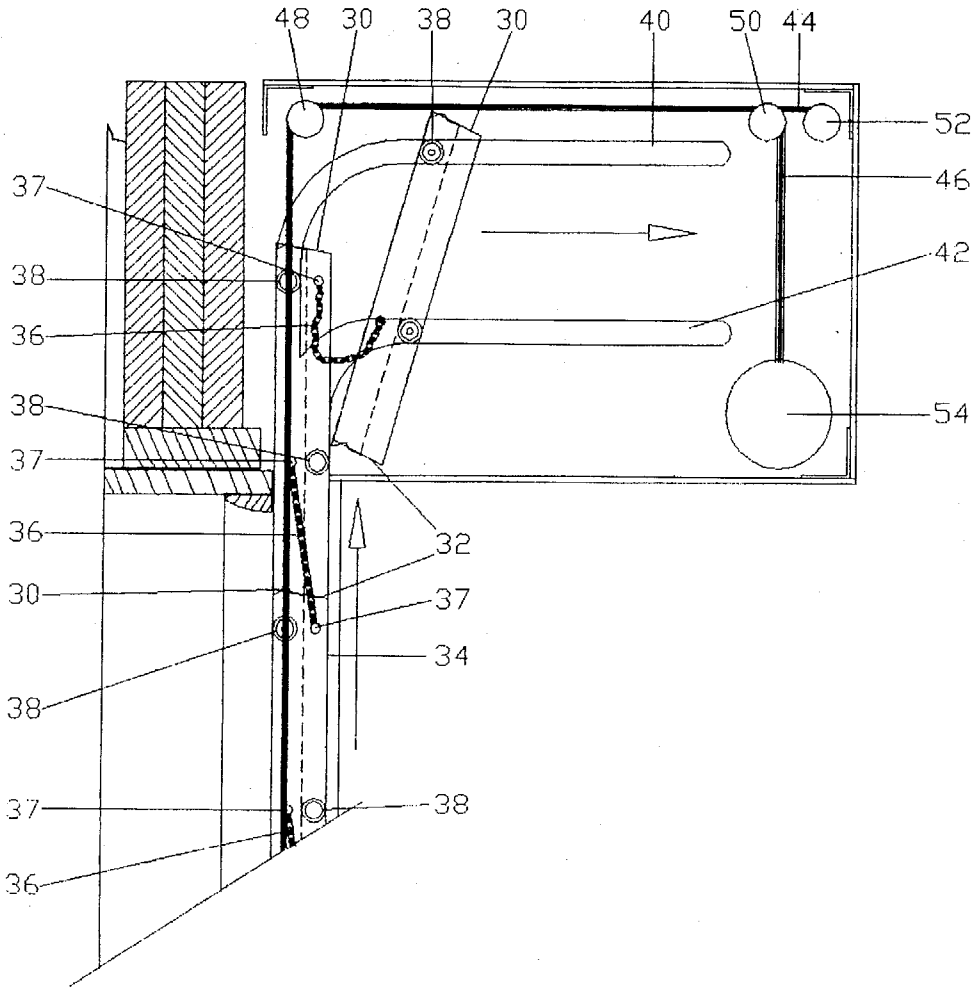
Figure 3D:
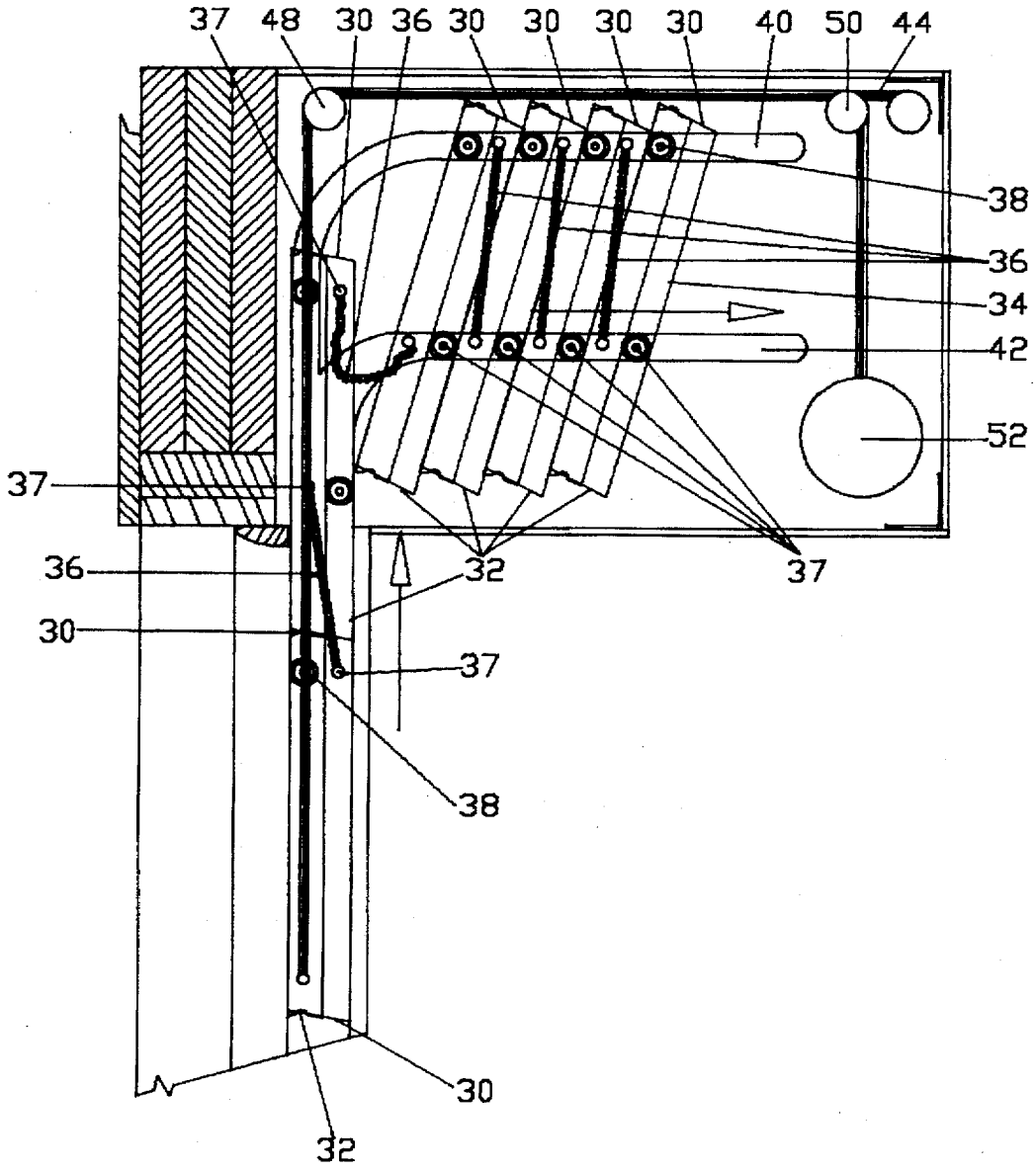
Figure 3E:
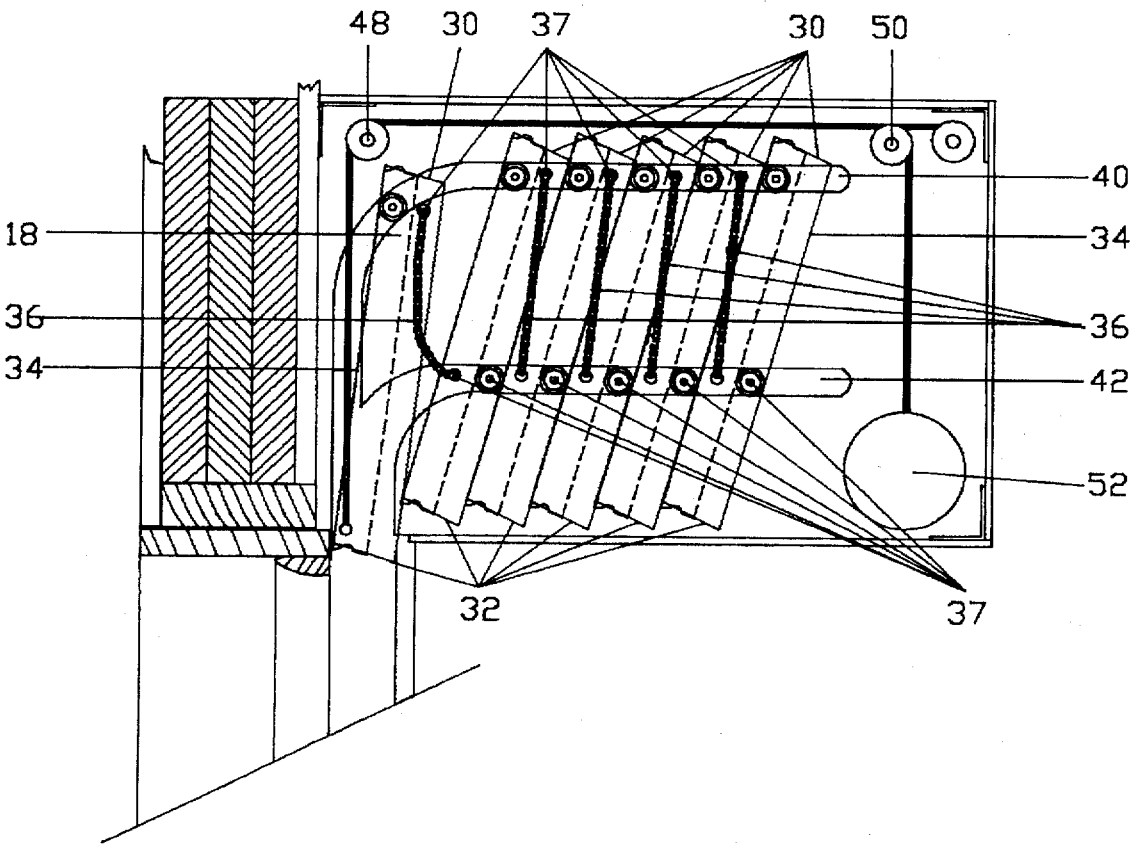

In the closure panel stowed position, as best shown in FIG. 3E, the actuators 18 have abutting inner and outer side surfaces 34 and parallel top edges 30 and parallel bottom edges 32. Top and bottom edges 30, 32 maintain their top and bottom orientation as shown in FIG. 3E. Thus, the closure system of the present invention is not an "accordion" type of folding door, where top and bottom positions reverse their orientation on every other closure panel. The present invention is a stacking type of closure system as opposed to a folding, "accordion" type of closure system. As shown in FIG. 3E, the bottommost actuator 18' need not be entirely moved to a position where the side surfaces 34 are abutting. The object of the invention is accomplished if substantially all of the actuators have abutting inner and outer side surface and parallel top and bottom edges, when in the stowed position.

Figure 2A:
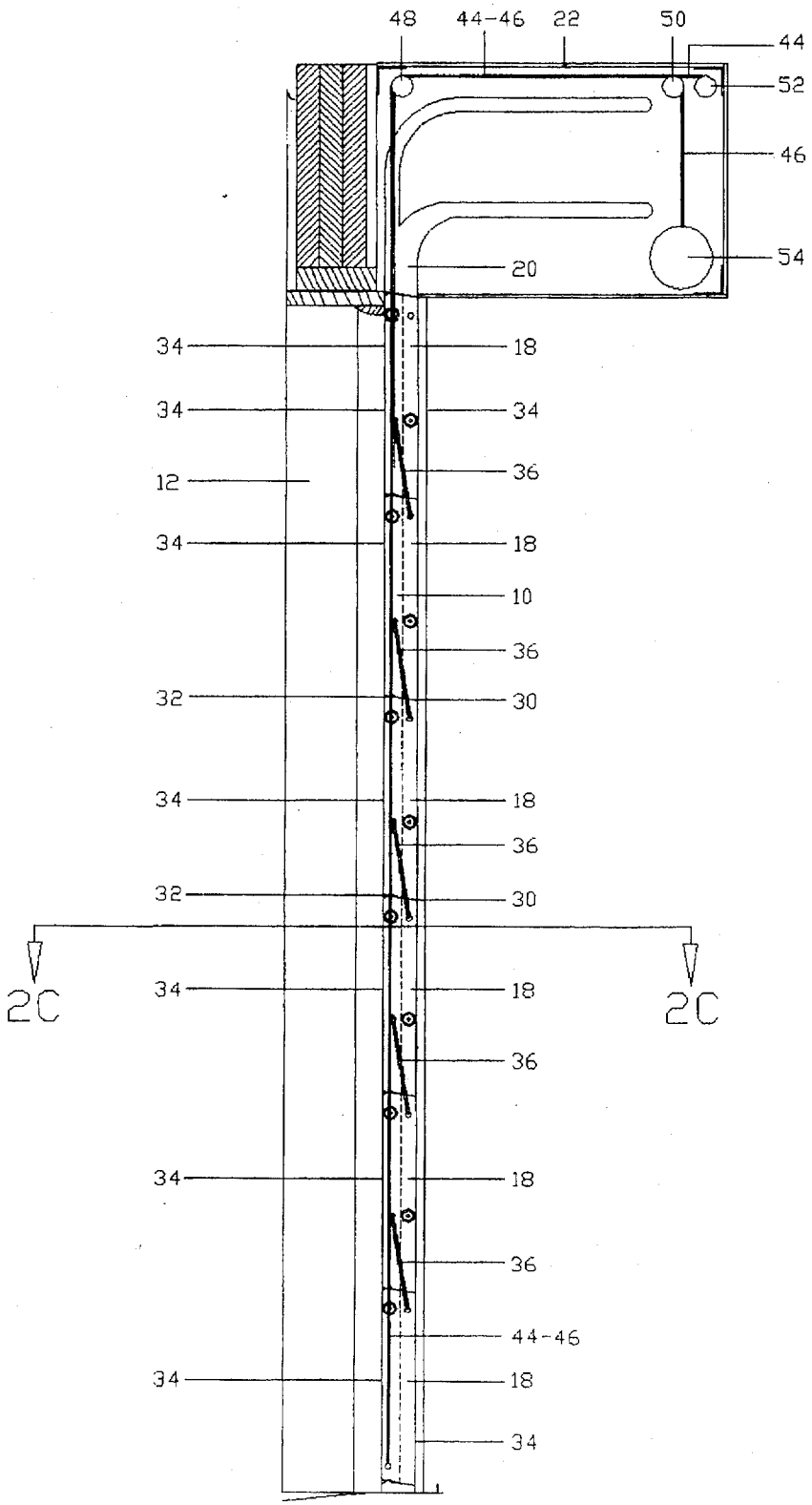
FIG. 2A is a partially broken-away side view taken along lines 2A—2A on FIG. 1.
Figure 2B:
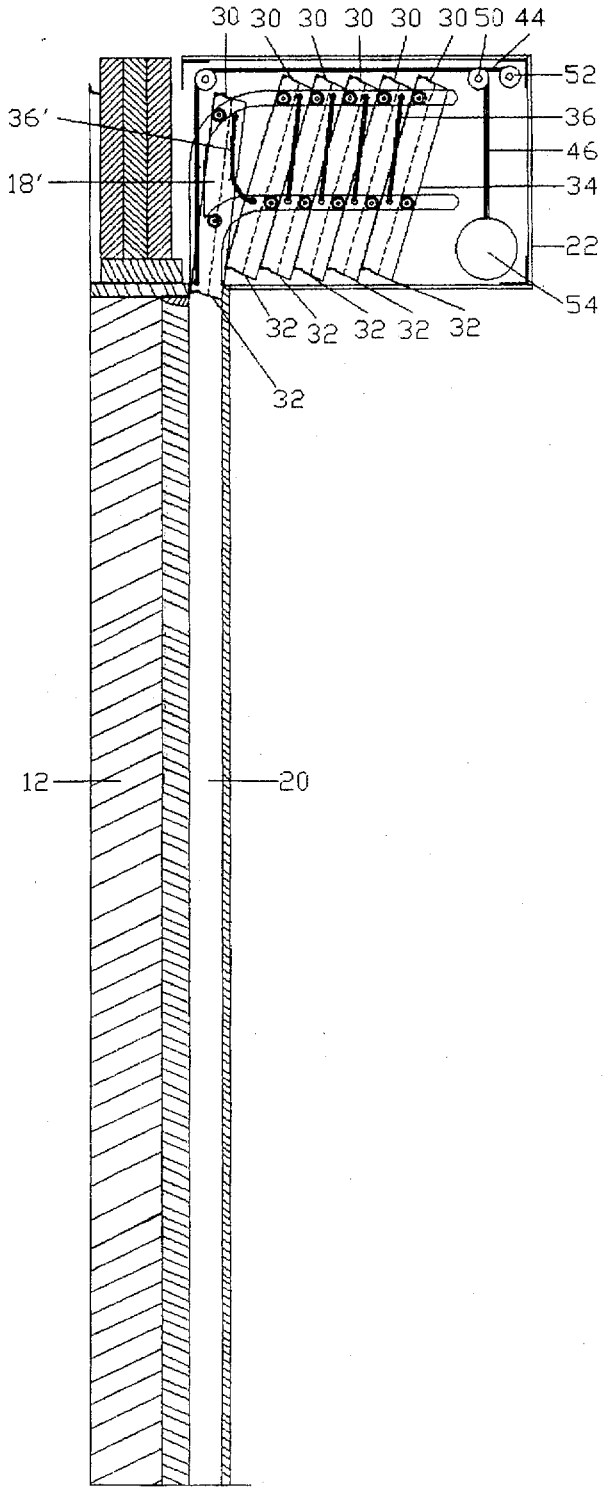
FIG. 2B is a view similar to FIG. 2A, with the closure system in the stowed position.
Figure 2C:
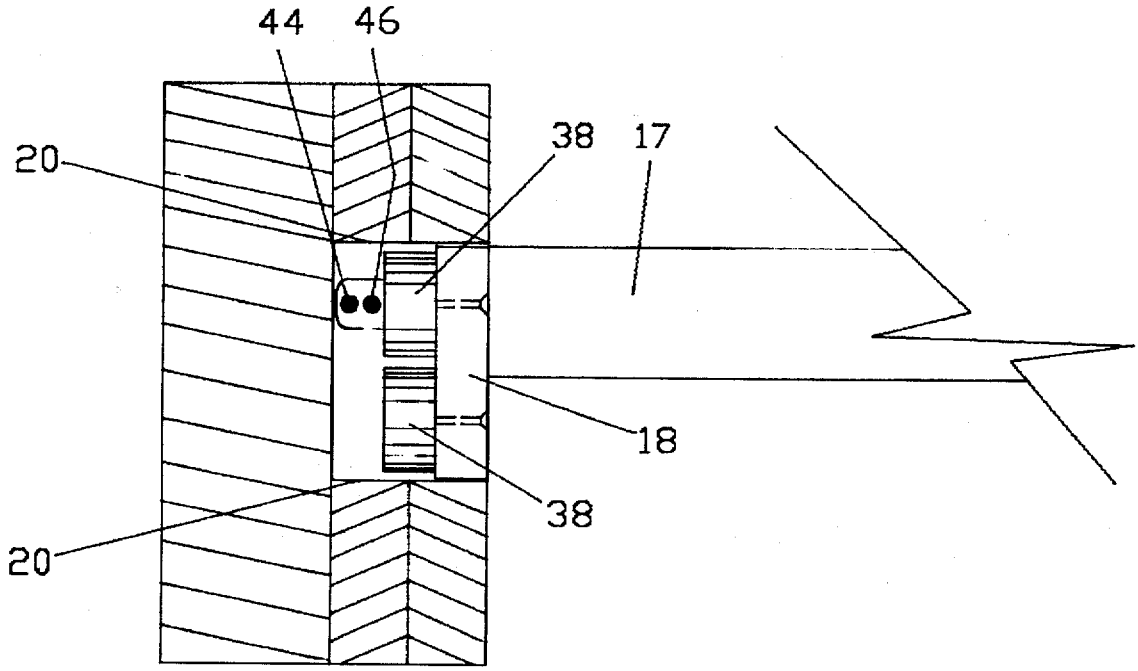
FIG. 2C is a sectional view taken along lines 2C—2C of FIG. 2A.

Non-rigid security links 36 span in between actuators 18. Security links 36 are best seen in FIGS. 3A–3E. The security links have lengths and attachment points 37 on the actuators adapted and arranged such that the security links 36 are taut when the closure panels 17 are in the deployed and stowed position but loose as the closure panels 17 transition between the deployed and stowed positions. As shown in FIG. 2A, all security links are taut. This provides a closure for the building opening that has no gaps and is suitably secure. Similarly, in FIG. 2B security links 36 are taut, with the possible exception of the bottommost security link 36' which optionally may be loose to permit faster deployment from the stowed position. FIG. 3E also illustrates the taut position of security links 36 in the stowed position. FIGS. 3B, 3C and FIG. 3D illustrate the transition of the closure panels 17 between the deployed and stowed position as well as the looseness of the security links 36 as the closure panels 17 undergo such transition. The looseness of the security links 36 during transition of the closure panels effectively decouples the closure panels from each other and permits the carrier rollers 38 to smoothly travel in carrier track 20. As best shown in FIGS. 3A–3E, carrier track 20 splits into an upper carrier track 40 and a lower carrier track 42 within enclosure 22. Carrier track 20 below enclosure 22 is approximately twice as wide as the carrier rollers 38, as best shown in FIG. 2C, but close tolerance fitted to enhance weather tightness.

As best shown in FIGS. 3A–3E, the vertical orientations of the security link attachment points 37 are reversed as the closure panels 17 transition between the deployed and stowed positions. The top and bottom edges 30 and 32 are slightly angled from horizontal when the closure members are in the deployed position, while the side surfaces 34 are slightly angled from vertical when the closure members are in the stowed position. Carrier rollers 38 on actuators 18 are adapted and arranged to engage the carrier tracks 20 such that the closure members tilt from vertical (FIG. 2A) to a slightly tilted orientation (FIGS. 3A–3E) as the closure panels 17 transition between the deployed and stowed positions. The feature of tilting permits smooth separation of the closure members 17 as they transition from deployed and stowed positions, and as shown in FIG. 3A for example, permits the disengagement of a weather stripping lip and accompanying groove in the top and bottom edges of the closure members 17.

As best shown in FIG. 3A, the tilting of the closure panels 17 during transition, in the preferred embodiment, is enabled by a dimension "x" between the initial points of curvature of the upper and lower carrier tracks 40, 42. Dimension "x" is smaller than a dimension "y" defined by the vertical spacing between carrier rollers 38 on the actuators 18.

Lift cable 44 and counterbalance cable 46 are both connected to each of the bottommost actuators 18'. Cables 44, 46 pass over idler pulleys 48 at the upper forward corners of enclosure 22. Lift cable 44 then passes over idler pulley 50 into a motorized winder 52. Counterbalance cable 46 passes directly into a spring-loaded winder 54, which is connected to a counterbalance spring (not shown). The counterbalance spring in the preferred embodiment provides a preload sufficient to carry the weight of the door.

In operation, when opening the system the bottommost panel 17 is lifted by cables 44, 46. Cable 46 is connected to the counterbalance spring which is designed to keep a programmed weight on the bottom edge at all times (approx. 20–25 lbs.). The lift cable 44 is attached to the motorized winder 54, a power lifting device. The double cable arrangement gives a fail safe design.

As the closure system is raised, the top carrier roller 38 on each actuator 18 contacts the arc of the upper carrier track, which causes the panel to tilt. This causes the joint between top and bottom edges 30,32 to open up, scissor-like, creating an angle between the edges which, combined with the slight diagonal cut of the joint, allows the panel to be pushed into the storage area of enclosure 22. The tipping of the panel also swings the lower roller into position to catch the lower carrier track, and as the panel is pushed in, the next lower panel goes past and repeats the procedure until all panels are properly stored.

As the closure system is lowered, the bottom most, first panel out of storage is not in the upper and lower carrier tracks but is suspended on the cables in the up position. As the lift cable 44 is reversed, the preprogrammed weight permitted by the counterbalance spring causes the panel to lower by gravity with the speed governed by feed of the lift cable. If the panel strikes any obstruction causing the lift cable to slacken, an automatic reverser (not shown) will retrieve the panels. Should the reverser malfunction, the maximum weight to rest on the obstruction is the 20–25 lbs. preprogrammed into the counterbalance string. If no obstruction occurs each panel will pull out the following panel by use of the security links and guided into proper position by the lower side of carrier track.

With all of the system panels enclosed in a storage enclosure 22, the use of dual cables 44,46, and the avoidance of a traditional closer pushing the door system down, this is the safest closure system available. If the counterbalance spring breaks, it is contained within the enclosure 22, and the lift cable 44 will safely lower the panels. On traditional systems, if a spring breaks, the broken piece will many times ricochet around the room like a bullet.

Whereas, the present invention has been described with the respect to a specific embodiment thereof, it will be understood that various changes and modifications will be suggested to one skilled in the art, and it is intended to encompass such changes and modifications as fall within the scope of the appended claims.

We claim:

1. A closure system, comprising:

a plurality of closure panels adapted to be moved between deployed and stowed positions along a pair of carrier tracks on opposite sides of a building opening, each closure panel having two opposite ends and an actuator on each end;

the actuators in the closure panel deployed position having abutting top and bottom edges and parallel side surfaces, such that the closure panels space across the building opening;

the actuators in the closure panel stowed position having abutting inner and outer side surfaces and parallel top edges and parallel bottom edges, with top and bottom edges maintaining their top and bottom orientation; and with non-rigid security links spanning between adjacent actuators, the security links having lengths and attachment points on the actuators adapted and arranged such that the security links are taut when the closure panels are in the deployed and stowed positions but loose as the closure panels transition between the deployed and stowed positions.

2. The closure system of claim 1 with vertical orientations of the attachment points being reversed as the closure panels transition between the deployed and stowed positions.

3. The closure system of claim 1 with the top and bottom edges being slightly angled from horizontal when the closure members are in the deployed position.

4. The closure system of claim 1 with the side surfaces being slightly angled from vertical when the closure members are in the stowed position.

5. The closure system of claim 1 with carrier rollers on ends of the closure members being adapted and arranged to engage the carrier tracks such that the closure members tilt from vertical to a slightly tilted orientation as the closure panels transition between the deployed and stowed positions.

6. The closure system of claim 5 with a dimension "x" between transition points on the carrier tracks being smaller than a dimension "y" between the carrier rollers.

7. A closure system, comprising:

a plurality of closure panels adapted to be moved between deployed and stowed positions along a pair of carrier tracks on opposite sides of a building opening, each closure panel having two opposite ends and an actuator on each end;

the actuators in the closure panel deployed position having abutting top and bottom edges and parallel side surfaces, such that the closure panels span across the building opening;

the actuators in the closure panel stowed position having abutting inner and outer side surfaces and parallel top edges and parallel bottom edges, with the top and bottom edges maintaining their top and bottom orientation;

with non-rigid security links spanning between adjacent actuators, the security links having lengths and attachment points on the actuators adapted and arranged such that the security links are taut when the closure panels are in the deployed and stowed positions but loose as the closure panels transition between the deployed and stowed positions;

with vertical orientations of the attachment points being reversed as the closure panels transition between the deployed and stowed positions;

with the top and bottom edges being slightly angled from horizontal when the closure members are in the deployed position;

with the side surfaces being slightly angled from vertical when the closure members are in the stowed position;

with carrier rollers on ends of the closure members being adapted and arranged to engage the carrier tracks such that the closure members tilt from vertical to a slightly tilted orientation as the closure panels transition between the deployed and stowed positions; and with a dimension "x" between transition points on the carrier tracks being smaller than a dimension "y" between the carrier rollers.

* * * * *